US008011647B2

(12) United States Patent
Kipping

(10) Patent No.: US 8,011,647 B2
(45) Date of Patent: Sep. 6, 2011

(54) KIT FOR ASSEMBLING A MODULAR BRACKET

(75) Inventor: Josef Kipping, Schmelz (DE)

(73) Assignee: ThyssenKrupp Drauz Nothelfer GmbH, Heilbronn (DE)

( * ) Notice: Subject to any disclaimer, the term of this patent is extended or adjusted under 35 U.S.C. 154(b) by 1199 days.

(21) Appl. No.: 11/575,350

(22) PCT Filed: Aug. 31, 2005

(86) PCT No.: PCT/EP2005/009355
§ 371 (c)(1),
(2), (4) Date: Mar. 15, 2007

(87) PCT Pub. No.: WO2006/032348
PCT Pub. Date: Mar. 30, 2006

(65) Prior Publication Data

US 2007/0216079 A1 Sep. 20, 2007

(30) Foreign Application Priority Data

Sep. 25, 2004 (DE) ..... 10 2004 046 592

(51) Int. Cl.
*B25B 1/22* (2006.01)

(52) U.S. Cl. ..... 269/71; 269/57

(58) Field of Classification Search ..... 269/71, 269/247, 45, 25, 43; *B23Q 3/10*
See application file for complete search history.

(56) References Cited

U.S. PATENT DOCUMENTS

| | | | | |
|---|---|---|---|---|
| 1,907,846 | A * | 5/1933 | Mandernack | 81/4 |
| 4,400,969 | A * | 8/1983 | Specktor | 72/457 |
| 4,951,932 | A | 8/1990 | Thomas | |
| 5,984,288 | A * | 11/1999 | Kipping | 269/25 |
| 6,322,063 | B1 * | 11/2001 | Steinhart | 269/152 |

FOREIGN PATENT DOCUMENTS

| | | |
|---|---|---|
| CA | 2 402 180 | 3/2004 |
| CH | 238 640 | 7/1945 |
| DE | 89 03 660 U1 | 5/1989 |
| DE | 91 09 306.6 | 1/1992 |
| DE | 44 07 241 A1 | 9/1995 |
| DE | 44 24 765 A1 | 1/1996 |
| DE | 296 00 649 U1 | 3/1996 |
| DE | 296 07 499 U1 | 7/1996 |
| DE | 297 17 355 U1 | 1/1998 |
| DE | 299 00 500 U1 | 5/1999 |
| DE | 198 28 779 A1 | 12/1999 |
| DE | 101 06 903 C1 | 8/2002 |

(Continued)

*Primary Examiner* — Lee D Wilson
*Assistant Examiner* — Jamal Daniel
(74) *Attorney, Agent, or Firm* — McGlew and Tuttle, P.C.

(57) ABSTRACT

A kit is provided for assembling a modular bracket (1) used, in particular for placing gripping and clamping devices or clamping components, in particular metal sheets on an assembly line. The kit has a base part (3) fixable on a solid support or a carrier, a tube (4) fixable to the base part (3) and a head part (5) which is fixable to the tube (4). The head part includes connecting surfaces for fixing the gripper on the clamping device. According to the invention, the head part (5) is continuously height-adjustable with respect to the tube (4), is pivotable about the central longitudinal axis thereof and, afterwards, frictionally and form-fittingly connectable to the tube (4).

8 Claims, 1 Drawing Sheet

FOREIGN PATENT DOCUMENTS

| | | | |
|---|---|---|---|
| DE | 101 07 969 | A1 | 8/2002 |
| DE | 101 24 927 | A1 | 12/2002 |
| DE | 203 02 577 | U1 | 4/2003 |
| DE | 203 18 749 | U1 | 3/2004 |
| EP | 0 804 996 | A | 11/1997 |
| EP | 828 686 | | 3/1998 |
| GB | 14 66 434 | | 3/1977 |
| WO | WO 96/38376 | | 12/1996 |

* cited by examiner

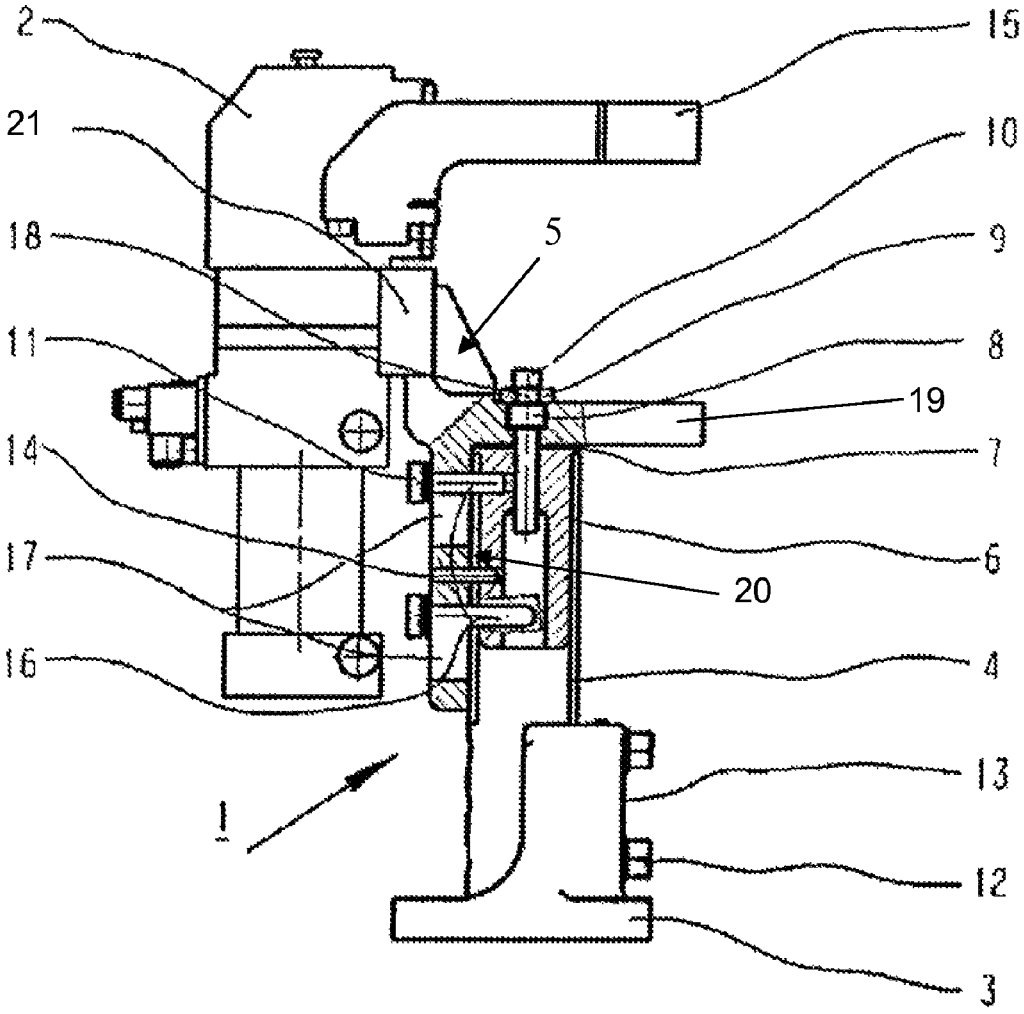
2
21
18
11
14
17
16
1
5
15
10
9
8
19
7
6
20
4
13
12
3

KIT FOR ASSEMBLING A MODULAR BRACKET

CROSS REFERENCE TO RELATED APPLICATIONS

This application is a United States National Phase application of International Application PCT/EP2005/009355 and claims the benefit of priority under 35 U.S.C. §119 of German Patent Application DE10 2004 046 592.4 filed Sep. 25, 2004, the entire contents of which are incorporated herein by reference.

FIELD OF THE INVENTION

The invention relates to a kit for assembling a modular bracket used, in particular, for placing gripping and clamping devices for clamping components, in particular metal sheets on an assembly line. The inventive kit comprises a base part fixable on a solid support or a carrier, a tube fixable to the base part, and a head part which is fixable to the tube and comprises connecting surfaces for fixing the gripper or a clamping device or similar devices.

BACKGROUND OF THE INVENTION

Brackets of this kind are particularly used in the automobile industry for car body construction, for example in order to hold components firm during assembly or to automatically restrain metal sheets that are to be welded to each other. In the course of an assembly line, a plurality of clamping brackets may therefore be arranged on fixing plates or carriers. Each of these clamping brackets must be designed and constructed according to the required spatial arrangement of the clamping point. Kits for assembling a modular bracket for this purpose are already available (for example vide EP 828 686 B1, EP 804 996 B1, DE 297 17 355 U1, DE 299 00 500 U1, and DE 101 06 903 C1).

A tripartite kit including a base part, pipe support and a head part is described in EP 828 586 B1. The length of the pipe support is cut to suit as required to adapt the bracket to the necessary height. A number of pipe pieces with graded lengths and existing thread bores for fixing to a base piece and a headpiece are available in general. A continuous fine adjustment, particularly of the height of the clamping point after installation of the pipe support, is not provided for therein.

With the kit according to DE 297 17 355 U1, an exchangeable adjusting plate of variable thickness is provided for to adapt the height between base part and support. Likewise, DE 101 06 903 C1 provides for firmly connecting the head part to the pipe support by the aid of an insertion piece and an exchangeable fitting pin after having laid one or more spacers onto the upper end of the pipe support. Apart from adjusting the height by means of the spacers, it also allows for aligning the head part by a given angle in a direction that is orthogonal to the pipe support. However, it does not allow either for an exact fine adjustment after installation.

The kit for assembling a modular clamping bracket according to DE 299 00 500 U1 provides for that the head part can optionally be adjusted in its angles around the central longitudinal axis of a fixing screw with respect to the pipe support and that it can be fixed by the aid of at least one cylindrical pin. But for this purpose, a fixing plate with a central thread bore for the fixing screw is welded into the upper end of the pipe support. Manufacture and mounting of this fixing plate to the pipe support is relatively costly.

Finally, the EP 804 996 B1 discloses a clamping kit system and a method for adjusting a basic length, wherein the base part and the head part are connected to each other by means of detachable threaded bolts and wherein the passage bores in the base part and head part are by a few millimeters larger than the diameter of a fitting shaft provided for at the threaded bolt. These enlarged diameters make it possible to achieve a fine adjustment of the basic length by means of set screws between base part and pipe support and/or between pipe support and head part after the base part and head part have been loosely screwed together with the pipe support. Twisting between the base part and pipe support and/or pipe support and head part around the longitudinal axis of the pipe support is not possible, because the pipe support has a mainly rectangular cross-section.

SUMMARY OF THE INVENTION

Now, therefore, it is the objective of the present invention to provide a kit of the generic species for a clamping bracket in which adequate fine adjustment is possible by means of simple, exchangeable components even after joining the components.

According to the invention, a kit is provided for assembling a modular bracket used, in particular for placing/positioning gripping and clamping devices for clamping components, in particular metal sheets on an assembly line. The kit comprising a base part fixable on a solid support or a carrier, a tube fixable to the base part and a head part which is fixable to the tube. The head part comprises connecting surfaces for fixing a positioned a connectable part, the gripper or a clamping device or similar devices. The head part and tube form a support adjustment and fixing means for the head part being continuously height adjustable with respect to the tube, being angularly adjustable with respect to the tube so as to be pivotable about the central longitudinal axis of the tube and afterwards being fixable to the tube, namely frictionally and form fittingly connectable to the tube.

According to the present invention it is provided for that the head part is continuously height-adjustable with respect to the tube and twistable around the longitudinal axis of the tube and afterwards frictionally and form-fittingly connectable to said tube. The kit is so designed that the individual modules are initially joined loosely, with it already being possible during this phase to fix the clamping device to the head part, and that afterwards, in conformity with the precise operational requirements, the continuous fine adjustment in terms of the height as well as the continuous fine adjustment is performed by twisting it around the longitudinal axis of the tube, and that subsequently the parts are firmly screwed together. For additional fixing in the final working position, the tube can be fixed both with respect to the head part and with respect to the base part by the subsequently mounting of bores and insertion of pins.

Apart from differently long tubes that are available in graded lengths and being prefabricated according to operational requirements, uniform module elements each are used with the inventive kit. This provides an adjustment connection means for connecting the head part to the tube and including loose adjustment connection means for loosely joining the head part to the tube allowing a fixing of the gripper or a clamping device to the head part and providing continuous axial fine adjustment of the head part relative to the tube as well as the continuous fine twisting adjustment around the longitudinal axis of the tube. The adjustment connection means also includes a fixing connection means providing subsequent firm fixing of a position of the head part relative to the tube. This includes, particularly, the insertion piece that can be inserted with sufficient play into the tube and that has an upper rim with a central threaded bore. Besides, a set-up screw is provided for height adjustment, the screw being pivoted with its screw head in the horizontal section of the head part and being screwable from the top into the central threaded bore of the insertion piece. The head of the set-up screw is held in the head part by an additional plate so that the distance between the head part and the tube changes when turning the set-up screw in the threaded bore through a forced guide. The head of the set-up screw is expediently located in a sink of the head part, with the screw itself projecting downward through a minor opening. Subsequently, a plate is laid from the top onto the horizontal area of the head part and screwed to it. The set-up screw is expediently actuated from the top through a passage opening existing in the plate. The insertion piece with the upper rim can be loosely introduced from the top into the tube. The outer diameter of the rim is larger than that of the insertion piece and it lies on the upper front face of the tube. To allow for the desired fine adjustment in the vertical and the horizontal direction, at least two oblong holes extending in parallel to each other in circumferential direction, preferably horizontally, are provided for. With such holes the screws for fixing the head part to the tube can be guided with sufficient play. These oblong holes extending in circumferential direction allow for a continuous twisting of the head part and of the insertion piece in a pre-defined angle versus the vertical tube. For fine adjustment in the vertical direction, appropriate vertical slots are provided for in the head part, with screws being guided in these slots with sufficient play. After fine adjustment of the height by the aid of the set-up screw and after twisting the head part versus the tube, the screws guided through the slots of the head part are tightened in the threaded bores of the insertion piece, thus achieving a frictional and form-fitting connection of the head part and insertion piece with the vertical tube arranged there between.

The present invention is outlined and elucidated in greater detail by way of the attached drawing. The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

In the drawing:

The only FIGURE is a partially sectional side view showing the bracket according to the invention.

DESCRIPTION OF THE PREFERRED EMBODIMENT

Referring to the drawing in particular, the only FIGURE shows the inventive bracket 1 and, as an example, pneumatic grippers 2 with the clamping arm 15 to be fastened thereto, with the present invention not relating to this pneumatic gripper 2. The bracket 1 is comprised of the base part 3 (known per se), which the tube 4 is fastened in a known manner with the screws 12 (which with connection openings form a tube and base connection means). Though this tube 4 is shown here in a vertical arrangement, and though the description given hereinabove only addresses a vertically arranged tube, this tube 4, too, may of course be arranged obliquely to the base part 3 in an actually known manner. From the afore mentioned. EP 828 586 B1 it is known, for example, that the tube is swivable versus the base part around a horizontal axis. Hence, the vertical tube 4 can in principle also be arranged obliquely so that the other built-on components are not arranged vertically but obliquely to suit. The insertion piece 6 with the upper rim 7 is inserted in the tube 4 from the top. The rim 7 has an outer diameter which is a little larger than that of the insertion piece 6 so that it lies-up on the upper front face of the tube 4, thus preventing the insertion piece 6 from slipping down further into the tube 4. In the insertion piece 6, centrally at the top, a threaded bore is arranged into which the set-up screw 8 can be screwed-in from the top. The head part 5 has a horizontal leg 19 which is arranged above rim 7, and a vertical leg 20, which leans in parallel to the upwardly directed leg 21 with build-on areas for the pneumatic clamping device 2. Provided for in the horizontal section of the head part 5 is a vertical passage opening to reach the set-up screw 8 which can be screwed-in from the top into the threaded bore of rim 7. In its upper area, the passage opening has a larger diameter which is so large that the head of the set-up screw 8 can be sunk with sufficient play into the horizontal leg of the head part. In its lower area, the diameter of the passage opening is adapted to the diameter of the set-up screw 8. These graded diameters make it possible that the set-up screw 8 is suspended in the horizontal section of head part 5, which means that it cannot slip through entirely. After having laid-in the set-up screw 8, the passage opening and the head of set-up screw 8 are held with sufficient play in the horizontal leg of head part 5 by the aid of plate 9 and screws 10. A small passage opening 18 is located in plate 9 above set-up screw 8, in order to turn set-up screw 8 for height-adjustment of head part 5 by means of an inbus wrench. During this twisting, head part 5 is forcibly moved in the vertical direction, with the screws 11 still being relaxed. A downward-pointing section of the vertical leg 18 has vertical slots or oblong holes 17 for the screws 11 which can be screwed-in from outside through these vertical slots or oblong holes 17 and through the oblong holes 16 in tube 4 in the threaded bores of the insertion piece 6.

The assembly and installation of the inventive bracket 1 is done in a manner that initially the base part 3 is firmly screwed to an underground and that a selected tube part 4 of a predefined length is fastened to it by the aid of screws 12. Pin 13 serves for additional fixing. Subsequently the insertion piece 6 is inserted from the top into the tube 4 and the head part 5 is loosely fixed by the aid of screws 11, with the screws 11 being screwed-in from outside through slots 17 and oblong holes 16 into the threaded bores of the insertion piece 6. Next the set-up screw 8 is laid-in, and also fixed towards the top by the aid of plate 9, and the set-up screw 8 is screwed through the passage opening 18 into the threaded bore of the insertion piece 6. Having built-on the pneumatic clamping device 2, it is then possible by the aid of set-up screw 8 to perform the fine adjustment with respect to the height of head part 5, with it being possible for screws 11, screwed-in loosely at that point, to glide in the vertical slots 17. Moreover, head part 5 can be twisted around the center axis of tube 4 until it reaches the exact final position, with screws 11 gliding in the horizontal oblong holes 16. When the exact final position of head part 5 has been determined, screws 11 are tightened. In addition, this position can still be fixed by providing a horizontal bore for clamping pin 14 into the head part 5, tube 4, and insertion piece 6.

In case that the length of the horizontal oblong holes 16 fails to be sufficient for the required angular adjustment of head part 5, it is possible to mount tube 4 in base 3 around the vertical axis in a position twisted by 180°. On both sides of tube 4, appropriate threaded bores for screws 12 are provided for this purpose.

While a specific embodiment of the invention has been shown and described in detail to illustrate the application of the principles of the invention, it will be understood that the invention may be embodied otherwise without departing from such principles.

The invention claimed is:

1. A kit for assembling a modular bracket used, in particular for placing a connectable part, gripping and clamping devices for clamping components, the kit comprising:

a base part fixable on a solid support or a carrier;

a tube fixable to the base part;

a head part which is fixable to the tube and comprises connecting surfaces for fixing the gripper or a clamping device or connectable part, said head part being continuously height adjustable with respect to said tube, being angularly adjustable and pivotable about a central longitudinal axis of said tube and subsequent to adjustment being frictionally and form fittingly connectable to said tube;

vertically extending slots arranged in a vertical downwardly directed leg of said head part; and an insertion piece for insertion with sufficient play into an end part of said tube, said insertion piece having an upper rim with a central threaded bore, and a set-up screw for height-adjustment of said head part can be turned into said threaded bore, and the head of said set-up screw is pivoted in said head part, and oblong holes extending in a circumferential direction are arranged in said tube to allow for continuous twisting of said head part with respect to said tube, and screws are conducted through said oblong holes, said screws providing for a frictional and form-fitting connection between said head part and said insertion piece with said tube arranged therebetween.

2. A kit as defined in claim 1, wherein said tube is additionally fixable by pins with respect to said base part and/or head part.

3. A kit as defined in claim 1, wherein the screw head of said set-up screw can be sunk from the top into said head part and is covered with sufficient play by a plate, and said set-up screw is pivotable through a passage opening in said plate.

4. A kit for assembling a modular gripping and clamping device bracket for placement of metal sheet clamping components on an assembly line, the kit comprising:

a base part with surface for fixing on a solid support or a carrier;

a tube having a longitudinal axis;

a tube and base connection means for fixing said tube to said base part;

a head part fixable to said tube, said head part comprising connecting surfaces for fixing a position of a gripper or a clamping device;

an adjustment connection means for connecting said head part to said tube and including loose adjustment connection means for loosely joining said head part to said tube allowing a fixing of the gripper or a clamping device to the head part and providing continuous axial fine adjustment of the head part relative to said tube as well as the continuous fine twisting adjustment around said longitudinal axis of said tube and including fixing connection means providing subsequent firm fixing of a position of said head part relative to said tube, wherein said adjustment connection means comprises:

an insertion piece for insertion with sufficient play into an end part of said tube, said insertion piece having an upper rim with a central threaded bore;

a set-up screw for height-adjustment of said head part, said set-up screw being turned into said threaded bore, said set-up screw having a set-up screw head pivoted in said head part;

oblong holes extending in a circumferential direction and defined in said tube to allow for continuous twisting of said head part with respect to said tube; and screws conducted through said oblong holes, said screws providing for a frictional and form-fitting connection between said head part and said insertion piece with said tube arranged therebetween.

5. A kit according to claim 4, wherein said adjustment connection means further comprises pins to fix said tube with respect to said head part.

6. A kit according to claim 4, wherein:

said set-up screw head can be sunk from the top into said head part;

said set-up screw head is covered with sufficient play by a plate; and said set-up screw is turnable through a passage opening in said plate.

7. A kit according to claim 4, wherein:

said head part includes an axially directed leg; and said adjustment connection means further comprises vertically extending slots for said screws, said vertically extending slots being arranged in said axially directed leg of said head part.

8. A kit for assembling a modular bracket used, in particular for placing a connectable part, gripping and clamping devices for clamping components, the kit comprising:

a base part fixable on a solid support or a carrier;

a tube fixable to the base part;

a head part which is fixable to the tube and comprises connecting surfaces for fixing the gripper or a clamping device or connectable part, said head part being continuously height adjustable with respect to said tube, being angularly adjustable and pivotable about a central longitudinal axis of said tube and subsequent to adjustment being frictionally and form fittingly connectable to said tube; and an insertion piece for insertion with sufficient play into an end part of said tube, said insertion piece having an upper rim with a central threaded bore, and a set-up screw for height-adjustment of said head part can be turned into said threaded bore, and the head of said set-up screw is pivoted in said head part, and oblong holes extending in circumferential direction are arranged in said tube to allow for continuous twisting of said head part with respect to said tube, and screws are conducted through said oblong holes, said screws providing for a frictional and form-fitting connection between said head part and said insertion piece with said tube arranged therebetween.

* * * * *